US005636566A

United States Patent [19]

Kipp

[11] Patent Number: 5,636,566

[45] Date of Patent: Jun. 10, 1997

[54] GRAVURE PRINTING UNIT FOR A ROTARY PRESS

[75] Inventor: Eberhard Kipp, Lienen, Germany

[73] Assignee: Windmoeller & Hoelscher, Lengerich, Germany

[21] Appl. No.: 506,511

[22] Filed: Jul. 24, 1995

[30] Foreign Application Priority Data

Aug. 4, 1994 [DE] Germany ..... 9412586 U

[51] Int. Cl.[6] ..... B41F 9/10

[52] U.S. Cl. ..... 101/153; 101/169

[58] Field of Search ..... 101/152, 153, 101/156, 169, 154, 167, 168, 350, 363, 366, 207–210, 155

[56] References Cited

U.S. PATENT DOCUMENTS 2,338,561 1/1944 Zuckerman ..... 101/157

FOREIGN PATENT DOCUMENTS 565416 10/1993 European Pat. Off. .
650943 10/1937 Germany .
683319 11/1939 Germany .
708771 7/1941 Germany .
727012 10/1942 Germany .

OTHER PUBLICATIONS

3M Zurichtung, Punkt fuer Punkt tonwertrichtig, In: Der-Polygraph, H.10/1961, S.596–602,634, S600 re.Sp.oben.
JP 4–275149 A., In: Patents Abstracts of Japan, M–1366, Febr. 15, 1993, vol.17, No. 74.

*Primary Examiner*—J. Reed Fisher
*Attorney, Agent, or Firm*—Jordan and Hamburg

[57] ABSTRACT

In a gravure printing unit for a rotary press, a plate cylinder supplied with printing ink from a printing unit and an impression roller, which lies essentially at right angles to the plate cylinder, form a roller gap, through which, when the rotary press is running, sheet material that is to be printed is passed. The plate cylinder rotates in a specified direction opposite to that of the impression roller and its rotational movement is composed of a leading, rotating sector from the inking unit to the roller gap and a trailing rotating sector from the roller gap to the inking unit. By means of an auxiliary device, printing ink is supplied to the peripheral surface of the plate cylinder on the trailing, rotating sector with the help of a flexible ink-supplying apron which, follows the peripheral surface of the plate cylinder, forming an ink-filled peripheral gap.

15 Claims, 3 Drawing Sheets

GRAVURE PRINTING UNIT FOR A ROTARY PRESS

BACKGROUND OF THE INVENTION

The invention relates to a gravure printing unit for a rotary press, with a plate cylinder supplied with printing ink from a printing unit and an impression roller, which lies essentially at right angles to the plate cylinder and forms a roller gap with it. When the rotary press is running, sheet material that is to be printed is passed through the roller gap, taking up printing ink from the peripheral surface of the plate cylinder. At the same time, the plate cylinder rotates in a specified direction opposite to that of the impression roller and its rotational movement is composed of a leading, rotating sector from the inking unit to the roller gap and a hailing rotating sector from the roller gap to the inking unit.

In the case of such gravure printing units, the printing sites of the plate cylinder forming the printing forme are recessed in the manner characteristic for gravure printing in the form of gravure cells of optimally different depth and/or area for holding the printing ink. The excess ink of the plate cylinder, supplied with printing ink from the inking unit, usually by being dipped in an ink fountain, is removed by a doctor blade or a similar stripping device. As the sheet of material, which is to be printed, is passed through the roller gap formed between the plate cylinder and the impression roller, the ink is sucked out of the gravure cells and transferred to the sheet. The leading rotating sector of the plate cylinder ends here. Since the gravure printing ink, aside from pigments, binders and fillers, contains volatile solvents, the tendency exists that the slight ink residues, which remain in the gravure cells when the ink is being transferred in the roller gap, dry out on the trailing rotating sector of the plate cylinder, before they reach the inking unit or the ink fountain on the trailing rotating sector, in order to be filled once again with printing ink there and returned on the leading rotating sector of the plate cylinder to the roller gap for transferring the printing image. This drying-out effect can vary depending on the composition of the ink and the construction of the gravure cells. The cumulative effect of such ink residues, which have dried out in the gravure cells, leads to a visible deterioration in the printing image produced because the ink absorption capacity of the gravure cells becomes increasingly less correspondingly.

SUMMARY OF THE INVENTION

It is therefore an object of the invention to provide a gravure printing unit for a rotary press, in which a drying out of ink residues in the gravure cells of the plate cylinder in the hailing rotating sector is counteracted, so as to prevent it.

Pursuant to the invention, this objective is accomplished by an auxiliary device for supplying printing ink to the peripheral surface of the plate cylinder on the trailing rotating sector with a flexible ink supplying apron, which follows the peripheral surface of the plate cylinder, forming an ink-filled peripheral gap with it. Due to the color-filled peripheral gap, which extends in the axial direction of the plate cylinder over the whole printing surface of this cylinder and, at the same time, advantageously commences in the circumferential direction with its upper longitudinal edge region as close as practically possible to and advisably at the roller gap and, with its lower longitudinal edge region, discharges into the ink supply of the ink fountain, the printing peripheral surface of the plate cylinder, leaving the roller gap, is largely covered by the ink-filled peripheral gap on the trailing rotating sector of the plate cylinder, so that any color residues in the gravure cells no longer can dry out because the gravure cells ate filled once more with ink immediately after they leave the roller gap and deposit the ink on the sheet being printed. By these means, a deterioration in the printing quality resulting from an increasingly reduced ink take-up capability of the gravure cells is largely avoided or precluded.

Numerous further distinguishing features of the invention arise out of the claims and the specification below in conjunction with the drawings, in which an embodiment of the object of the invention is shown diagrammatically. In the accompanying,

DESCRIPTION OF THE PREFERRED EMBODIMENTS

Figure 1:
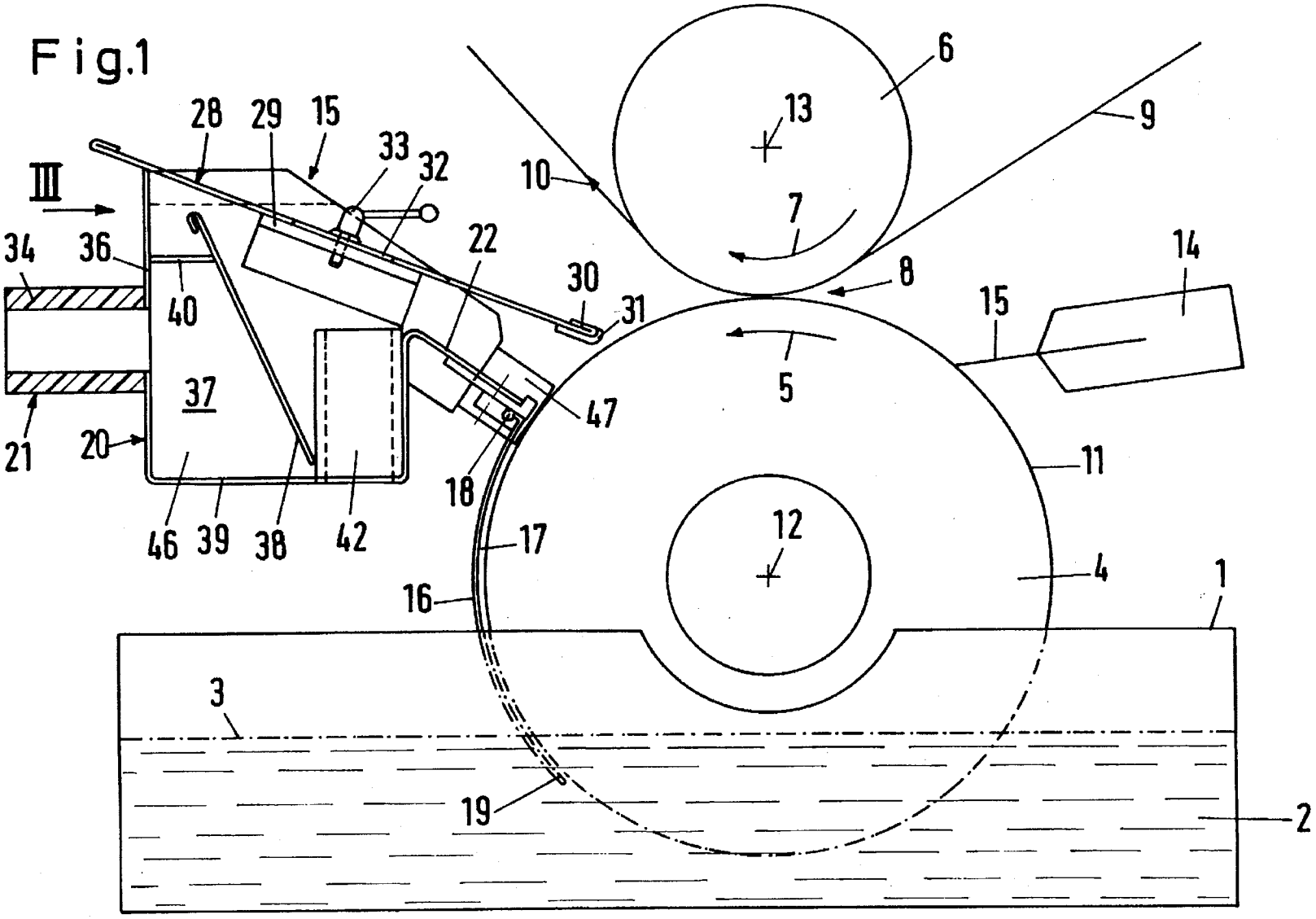
FIG. 1 shows a partially sectional side view of an inventive gravure printing unit with an auxiliary device for supplying printing ink to the plate cylinder.

As is evident, to begin with, from FIG. 1, the gravure printing unit for a rotary press that is shown comprises an ink fountain I as inking unit, which is filled with printing ink 2 and the liquid level of which is labeled 3. A gravure printing plate cylinder 4, the printing peripheral surface of which has gravure cells (not shown) for taking up printing ink 2, is mounted so that it can rotate above the ink fountain 1 in the direction of the arrow 5 in such a way that, as it is rotating, while the press is running it dips into the printing ink 2 so that the gravure cells are filled with the printing ink 2. Perpendicularly above the plate cylinder 4, an impression roller 6 with an elastic jacket, a so-called rubber impression roller, is mounted rotatably for rotating in the direction of arrow 7 opposite to the direction of rotation of the plate cylinder 4. The impression roller 6, together with the plate cylinder 4, forms a roller gap 8, through which the sheet-shaped material 9, which is to be printed, is passed during the operation of the press in the direction of the arrow 10 in order to take up printing ink 2 from the peripheral surface 11 of the plate cylinder 4.

The rotational movement of the plate cylinder 4, that is, a revolution through 360°, can be thought of as being composed of a leading rotating sector of 180° from the ink fountain 1, that is, of a vertical plane 12, 13, containing the axes of rotation 12 and 13 of the plate cylinder 4 and the impression roller 6, up to the roller gap 8 at the intersection with the vertical planes 12, 13 and of a trailing, rotating sector, which starts out from there and ends in the ink fountain at the intersection with the vertical planes 12, 13.

For carrying out the printing process, excess printing ink 2 on the leading rotating sector of the plate cylinder 4 is stripped from the peripheral surface 11 of the latter with the help of a doctor blade 14, the stripping knife 15 of which engages the peripheral surface 11. Immediately afterwards, in the roller gap 8, the printing ink 2 is sucked out of the gravure cells of the peripheral surface 11 by means of the impression roller 6 exerting an elastic counterpressure and is taken up by the sheet 9, which is to be printed, for the transfer of the printing image.

After leaving the roller gap 8, the gravure cells of the peripheral surface 11 on the trailing rotating sector of the plate cylinder 4 are emptied with the exception of possible ink residues. In order to prevent any drying out of these ink residues by evaporation of the solvent on the trailing rotating sector of the plate cylinder 4 before the latter is dipped once again into the printing ink 2, an auxiliary device is provided, which is labeled 15 as a whole and in turn supplies printing ink of the same type as the printing ink 2 of the peripheral surface 11 of the plate cylinder 4 to the trailing rotating sector. For this purpose, the auxiliary device 15 is provided with a flexible ink-supplying apron 16, which follows the peripheral surface 11 of the plate cylinder 4 forming an ink-filled peripheral gap 17 with it.

The ink-supplying apron 16 is formed by a solvent-resistant flat material, such as a fabric or a sheet, preferably from a plastic such as polyamide or polytetrafluoroethylene. In the axial direction of the plate cylinder 4, the ink-supplying apron 16 extends over the whole of the printing peripheral surface 11. It is mounted so that it hangs freely downwards with its upper longitudinal edge 18 at the auxiliary device 15 as close as possible to it and near the roller gap 8, so that the ink-supplying apron 16, with the greater part of its peripheral extent, is above the ink level 3 of the ink fountain 1 and extends over the peripheral surface 11. With its lower longitudinal edge 19, the ink-supplying apron 16, together with the plate cylinder 4, dips into the printing ink 2 of the ink fountain 1.

For supplying printing ink to the peripheral gap 17, the auxiliary device 15 comprises an ink trough 20, the axial length of which corresponds to that of the plate cylinder 4 and which is provided with an ink inlet 21, and an ink drainage wall 22, which extends over the length of the ink trough 20, ends at the upper longitudinal edge 18 of the ink-supplying apron 16 and is inclined at an angle to the latter.

Figure 2:
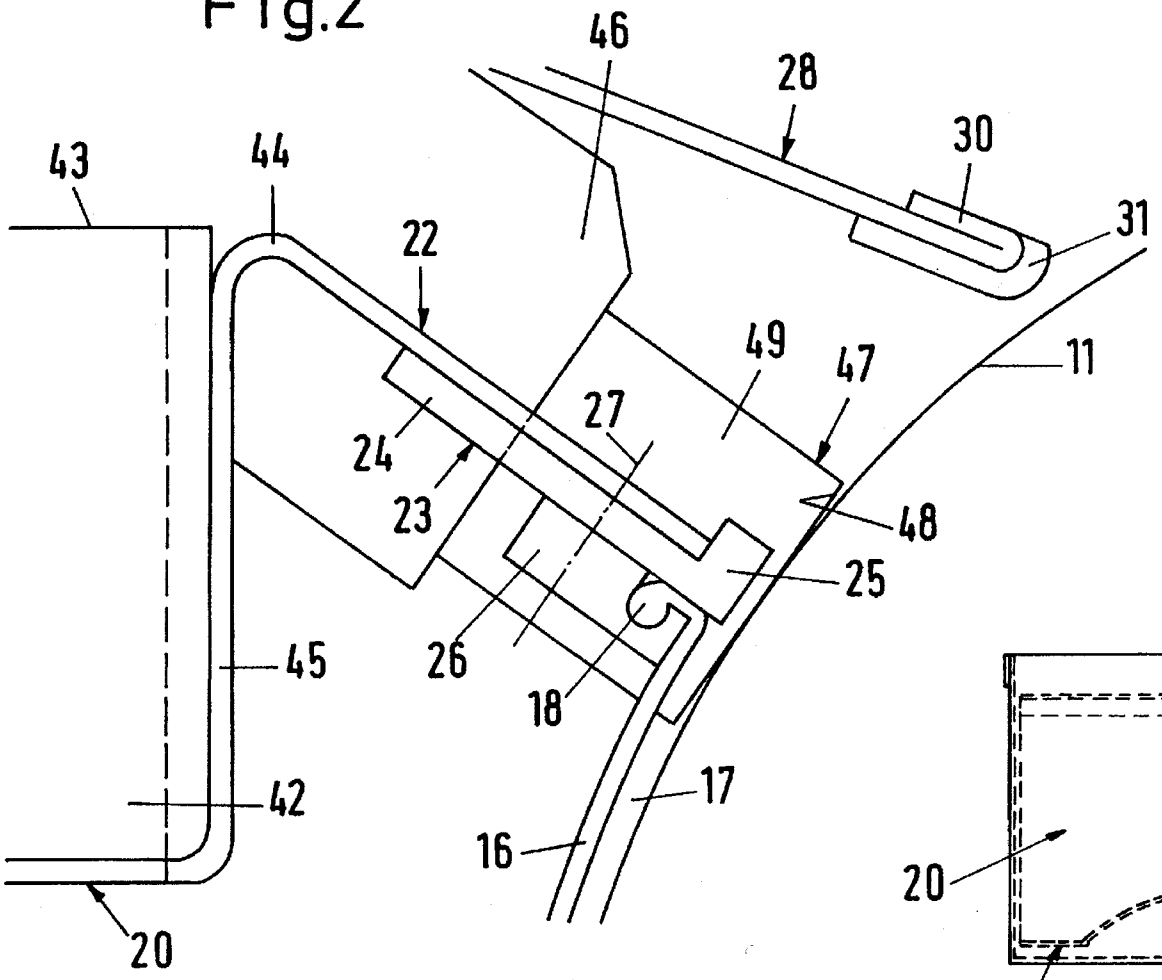
FIG. 2 shows an enlarged detailed representation of the auxiliary device of FIG. 1.

The upper longitudinal edge 18 of the ink-supplying apron 16 is fixed against the underside of the ink drainage wall 22 and, moreover, as can be seen particularly in FIG. 2, with the interpositioning of a continuous sealing lip 23 of L-shaped cross section, of which the long leg 24 forms a fastening leg and the short, thickened end leg 25 forms a sealing strip at the upper longitudinal edge of the peripheral gap 17. Below the sealing lip 23, there is a holding strip 26 with a groove for accommodating an appropriately contoured holding rod at the longitudinal edge 18 of the ink-supplying apron 16, which rod is placed in the accommodating groove. By means of a bolted connection, indicated at 27 by a line of dots and dashes, the ink drainage wall 22, the fastening leg 24 of the sealing lip 23 and the holding strip 26 are firmly connected to one another over their length.

The upper side of the ink trough 20 can be closed off by a cover 28, which is supported on lateral brackets 29 of the ink trough 20. With its longitudinal edge 30 facing the plate cylinder 4, the cover 28 is brought close to the peripheral surface 11 of the plate cylinder 4. By these means, the upper open edge of the peripheral gap 17 is shielded additionally. To avoid damaging the peripheral surface 11, the edge 30 of the cover 28 is provided with a sealing strip 31.

In the region of the two lateral fastening brackets 29, the cover 28 is provided in each case with an elongated hole 32, which enables the distance between the peripheral surface 11 of the plate cylinder 4 and the cover 28 to be varied with the help of a clamping toggle lever lock 33.

The ink inlet 21, formed at the side of the ink trough 20 opposite to the ink drainage wall 22, comprises two inlet channels 34, one on each side of a central transverse plane 35 of the adjoining ink trough wall 36, through which they discharge into an inner ink-distributing space 37 of the ink trough 20. Moreover, the ink trough 20 or its distributing space 37 is divided in the longitudinal direction by a central distributing wall 38, against which the flow of the ink through the supplying ducts 34 is directed. In a manner, the details of which are not shown, the distributing wall 38 is supported at its lower end at the bottom wall 39 and, at its upper end, inclined to the inlet 21, by an upper transverse wall 40 at the trough wall 36.

Figure 3:
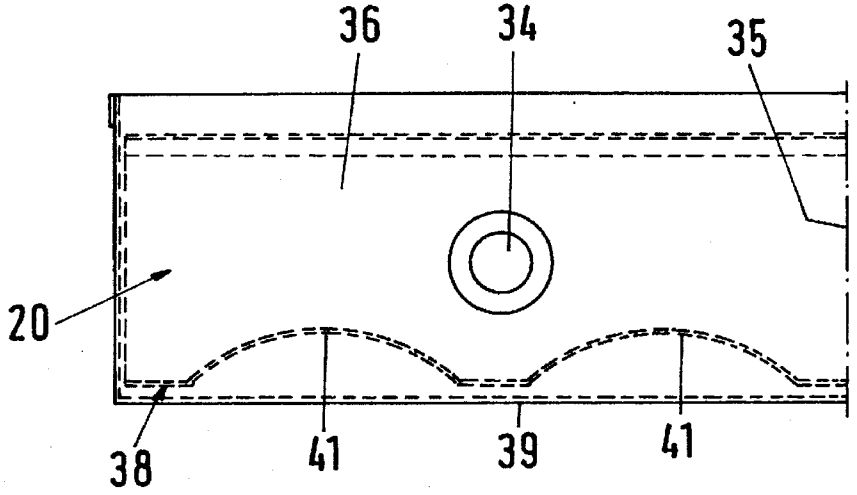
FIG. 3 shows a view of the auxiliary device in the direction of arrow III of FIG. 1 and limited to one-half.

The distributing wall 38, inclined in this manner, in conjunction with flow openings provided in a specified pattern, brings about a preliminary distribution of the printing ink supplied through the inlet 21. As can be seen particularly in FIG. 3, these flow openings are formed symmetrically on both sides of the central transverse plane 35 by recesses 41 in the distributing wall 36, which in each case star out from the lower edge of the distributing wall 36 adjoining the bottom wall 39.

In its comer regions adjoining the ink drainage wall 22, the ink trough 20 is in each case provided with an overflow connection piece 42, the upper inflowing edge 43 of which is slightly higher, for example, by 1 to 2 mm, than a longitudinal, convexly curved overflow edge 44 of the ink drainage wall 22, with which the latter goes over into the adjoining, perpendicular, longitudinal side wall 45 of the ink trough 20. Thus, over the overflow edge 44, the ink drainage wall 22 is in open connection with the ink distributing space 37 of the ink trough 20.

When the press is running, the ink distributing wall 38 is interposed and the ink distributing space 37 is filled with printing ink in a controlled manner so that, on the side of the distributing space 37 facing the plate cylinder 4, there is printing ink up to the level of the overflow edge 44 of the ink drainage wall 22 so that printing ink is supplied to the peripheral gap 17 constantly and uniformly over the overflow edge 44. If this level is exceeded because of fluctuations in the supply of printing ink, such excess of printing ink is discharged through the overflow connection piece 42. The printing ink, so supplied, reaches the peripheral gap 17 over the sealing strip 25 and fills this gap 17 uniformly with printing ink, the peripheral gap 17 combining at the level 3 of the ink with the printing ink 2 in the ink fountain 1. Since the ink-supplying apron 16 is freely suspended from its upper edge 18, the ink-filled peripheral gap 17 is formed due to the flexibility of the ink-supplying apron 16 by the rotating plate cylinder 4 deflecting the ink-supplying apron 16 in accordance with its peripheral surface 11. The printing ink is held in the peripheral gap 17 by the adhesion between the ink-supplying apron 16 and the peripheral area 11. Slight amounts of ink, which emerge at the open front faces of the peripheral gap 17, are collected in the ink fountain 1.

The ink trough 20 is provided on the outside at its transverse side walls 46 with a supporting block 47. The supporting blocks 47 are formed from wear-resistant and solvent-resistant plastic blocks of, for example, polyamide or polytetrafluoroethylene and have external straight-milled end faces 48 as contacting surfaces, which in each case, during a press run, lie with a printing forme-free peripheral end region of the plate cylinder 4 against the end face of the plate cylinder 4. The ink trough 30 is supported essentially linearly at the peripheral surface 11 of the plate cylinder 4, thus determining the width of the peripheral gap 17. The inwardly directed side surface 49 of the supporting blocks 47 closes off the peripheral gap 17 at the end faces in the region of the ink inlet over the ink drainage wall 22. The region of contact between the supporting blocks 47 and the peripheral surface 11 of the plate cylinder 4 is lubricated by the inflowing printing ink, so that wear at the supporting blocks 47 is reduced. However, the rotation of the plate cylinder 4 is not adversely affected.

Figure 4:
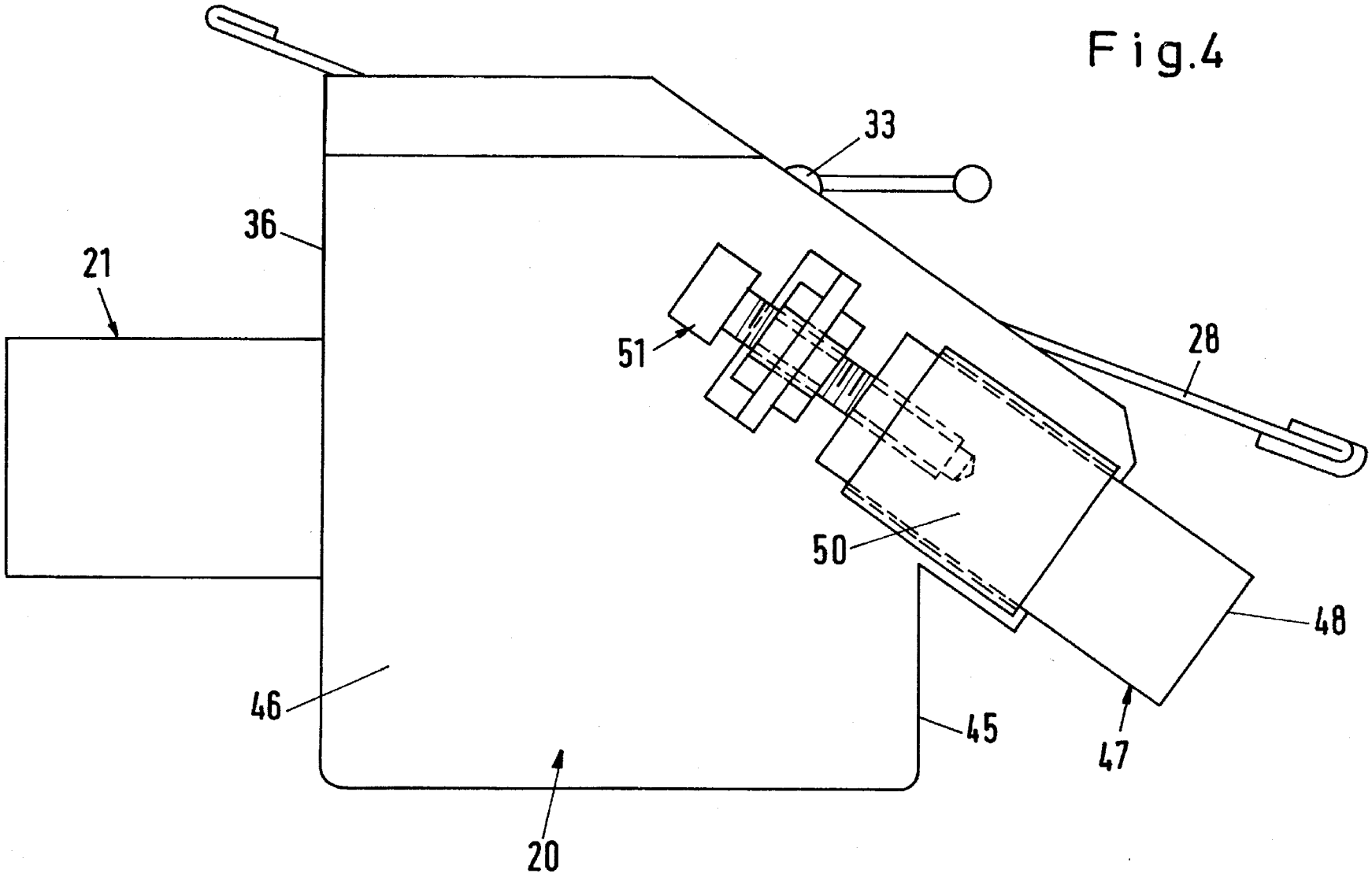
FIG. 4 shows an enlarged side view of the auxiliary device of FIG. 1 in order to illustrate a detail.

The distance of the ink-supplying apron 16 from the periphery of the plate cylinder 4 at the upper longitudinal edge 18 preferably is variable so that the width of the ink-filled peripheral gap 17 can be changed. For this purpose, as can be seen particularly in FIG. 4, the supporting blocks 47 are supported so that they can be shifted longitudinally in guiding and holding jackets 50 fastened to the outside of the transverse side walls 46 of the ink trough 20 and can be moved back and forth with respect to the peripheral surface 11 of the plate cylinder 4 and fixed in the set position by means of a threaded adjusting device 51 for shifting the respective supporting block 47 in order to change the width of the ink-filled peripheral gap 17.

I claim:

1. A gravure printing apparatus for a rotary press comprising a plate cylinder having a peripheral surface, an inking unit for supplying ink to said peripheral surface of said plate cylinder, an impression roller disposed to form a roller gap between said plate cylinder and said impression roller with a sheet to be printed passing through said roller gap and taking up ink from the peripheral surface of said plate cylinder when the rotary press is running, said plate cylinder being rotated in a direction opposite to the direction of rotation of said impression roller, said plate cylinder having a leading rotational sector extending between said roller gap and said inking unit and a trailing rotational sector extending between said roller gap and said inking unit, and auxiliary ink means supplying ink to said peripheral surface of said plate cylinder at said trailing rotational sector, said auxiliary ink means comprising a flexible ink-supplying apron means disposed about said peripheral surface of said plate cylinder and forming an ink-filled peripheral gap between said apron means and said peripheral surface of said plate cylinder.

2. A gravure printing apparatus according to claim 1 wherein said peripheral surface of said plate cylinder has an axial length, said apron means extending longitudinally over said axial length of said peripheral surface of said plate cylinder, said apron means comprising an apron element spaced from said peripheral surface of said plate cylinder to thereby form said ink-filled peripheral gap between said apron element and said peripheral surface of said plate cylinder, said apron element having an upper edge portion, said apron means further comprising suspension means suspending said apron element at said upper edge portion.

3. A gravure printing apparatus according to claim 2 wherein said inking unit comprises an ink container containing ink at an ink level, said apron element having a major portion thereof disposed above said ink level.

4. A gravure printing apparatus according to claim 3 wherein said upper edge portion of said apron element is disposed juxtaposed to said roller gap, said apron element having a lower edge portion, said lower edge portion together with a portion of said plate cylinder being immersed in said ink in said ink container.

5. A gravure printing apparatus according to claim 2 wherein said apron element is formed from a flat and solvent resistant material.

6. A gravure printing apparatus according to claim 1 wherein said auxiliary ink means comprises an ink trough having an axial length substantially equal to the axial length of said plate cylinder, said apron means having an upper longitudinal edge, said ink trough having an inclined ink drainage wall having a lower end juxtaposed to said upper longitudinal edge of said apron means.

7. A gravure printing apparatus according to claim 6 wherein said inclined ink drainage wall has an underside, and securing means securing said upper longitudinal edge of said apron means to said underside of said inclined ink drainage wall.

8. A gravure printing apparatus according to claim 6 wherein said auxiliary ink means further comprises an upper cover on said ink trough, and adjustable mounting means adjustably mounting said upper cover for sliding movement relative to said peripheral surface of said plate cylinder.

9. A gravure printing apparatus according to claim 6 wherein said ink trough has a first side and a second side spaced from said first side, said inclined ink drainage wall being juxtaposed to said first side of said trough, ink inlet means disposed at said second side of said ink trough, said ink trough having a central distributing wall towards which the ink entering said ink trough through said ink inlet means is directed.

10. A gravure printing apparatus according to claim 9 wherein said distributing wall is provided with flow openings through which said ink in said trough passes.

11. A gravure printing apparatus according to claim 10 wherein said distributing wall has a lower edge, said flow openings being partially defined by said lower edge of said distributing wall.

12. A gravure printing apparatus according to claim 6 wherein said ink trough has corner portions juxtaposed to said inclined ink drainage wall, overflow connection pieces disposed at each of said corner portions, said overflow connection pieces having an upper inflowing edge, said inclined ink drainage wall having an upper overflow edge, said upper inflowing edge of said overflow connection pieces being disposed at a higher elevation than said upper overflow edge of said inclined ink drainage wall.

13. A gravure printing apparatus according to claim 1 wherein said auxiliary ink means further comprises adjusting means for adjusting the distance between said apron means and said peripheral surface of said plate cylinder, thereby adjusting the width of said ink-filled peripheral gap.

14. A gravure printing apparatus according to claim 6 wherein said auxiliary ink means further comprises supporting blocks, and adjustable mounting means adjustably mounting said supporting blocks on said ink trough for selective movement relative to said peripheral surface of said plate cylinder to thereby adjust the width of said ink-filled peripheral gap.

15. A gravure printing apparatus according to claim 14 wherein said supporting blocks are made of wear-resistant plastic material, said supporting blocks having an outer surface facing said peripheral surface of said plate cylinder.

* * * * *